US007210525B2

(12) United States Patent
Dallas

(10) Patent No.: US 7,210,525 B2
(45) Date of Patent: May 1, 2007

(54) APPARATUS FOR CONTROLLING A TOOL HAVING A MANDREL THAT MUST BE STROKED INTO OR OUT OF A WELL

(75) Inventor: L. Murray Dallas, Fairview, TX (US)

(73) Assignee: Stinger Wellhead Protection, Inc., Allen, TX (US)

( * ) Notice: Subject to any disclaimer, the term of this patent is extended or adjusted under 35 U.S.C. 154(b) by 123 days.

(21) Appl. No.: 10/727,806

(22) Filed: Dec. 4, 2003

(65) Prior Publication Data

US 2004/0173347 A1 Sep. 9, 2004

(30) Foreign Application Priority Data

Mar. 7, 2003 (CA) ..... 2421348

(51) Int. Cl.
*E21B 33/03* (2006.01)

(52) U.S. Cl. ..... 166/77.4; 166/85.1; 166/84.1; 166/77.51

(58) Field of Classification Search ..... 166/77.4, 166/77.51, 85.1, 88.1, 88.4, 84.1
See application file for complete search history.

(56) References Cited

U.S. PATENT DOCUMENTS 1,586,923 A * 6/1926 Townsend ..... 166/77.4
1,934,955 A * 11/1933 Thrupp ..... 166/77.4
4,241,786 A 12/1980 Bullen
4,632,183 A 12/1986 McLeod
4,867,243 A 9/1989 Garner et al.
5,025,857 A * 6/1991 McLeod ..... 166/77.4
5,927,405 A 7/1999 Monjure et al.
6,009,941 A 1/2000 Haynes ..... 166/72
6,019,175 A 2/2000 Haynes ..... 166/382
6,145,596 A 11/2000 Dallas ..... 166/379
6,209,633 B1 4/2001 Haynes ..... 166/72
6,220,363 B1 4/2001 Dallas ..... 166/382
6,234,253 B1 * 5/2001 Dallas ..... 166/77.4
6,289,993 B1 9/2001 Dallas ..... 166/386
6,315,050 B2 11/2001 Vaynshteyn et al.
6,470,965 B1 10/2002 Winzer
6,595,297 B2 7/2003 Dallas
6,626,245 B1 9/2003 Dallas ..... 166/379
6,695,064 B2 2/2004 Dallas ..... 166/382
6,712,147 B2 3/2004 Dallas ..... 166/379
6,817,423 B2 11/2004 Dallas ..... 166/382
6,827,147 B2 12/2004 Dallas ..... 166/379

(Continued)

*Primary Examiner*—David Bagnell
*Assistant Examiner*—Matthew J. Smith
(74) *Attorney, Agent, or Firm*—Nelson Mullins Riley & Scarborough, LLP

(57) ABSTRACT

An apparatus for controlling vertical movement of a tubular within a wellhead includes an anchor spool connected atop the wellhead, and a detachable superstructure supporting the tubular. The anchor spool provides connectors for detachably connecting bottom ends of at least two piston cylinders of the detachable superstructure. The tubular may be a landing joint or a high-pressure mandrel of either a well stimulation tool, or a well isolation tool. The apparatus provides unobstructed access to a top end of the tubular. The anchor spool includes an elongated sidewall and an axial passage through which a tubing hanger can be reciprocated. The height of the sidewall permits the apparatus to be used for landing/removing a tubing string even if the anchor spool is mounted directly to a blowout preventer (BOP).

17 Claims, 4 Drawing Sheets

U.S. PATENT DOCUMENTS 6,918,439 B2 7/2005 Dallas ..... 166/85.3
6,948,565 B2 9/2005 Dallas ..... 166/382
2005/0016736 A1 1/2005 Dallas ..... 166/377

* cited by examiner

APPARATUS FOR CONTROLLING A TOOL HAVING A MANDREL THAT MUST BE STROKED INTO OR OUT OF A WELL

CROSS-REFERENCE TO RELATED APPLICATIONS

Not Applicable.

MICROFICHE APPENDIX

Not Applicable.

TECHNICAL FIELD

The present invention relates to equipment for servicing oil and gas wells and, in particular, to an apparatus for controlling a tool having a mandrel or other tubular that must be stroked into or out of a high-pressure well.

BACKGROUND OF THE INVENTION

Most oil and gas wells eventually require some form of stimulation to enhance hydrocarbon flow in order to make or keep them economically viable. The servicing of oil and gas wells to stimulate production requires the pumping of fluids under high-pressure. The fluids are generally corrosive and abrasive because they are frequently laden with corrosive acids and abrasive propants such as sharp sand.

Wellheads are not designed to accommodate delivery of high-pressure, abrasive fluids into the well. Consequently, isolation tools in various forms and configurations have been invented to protect wellheads during well stimulation processes. As knowledge of well stimulation processes have developed, the importance of high delivery rates for successful and economic stimulation processes has been appreciated. Consequently, it is now Applicant's practice to run large bore mandrels through blowout preventers (BOPs) mounted to a well in order to enhance stimulation effects and reduce job time.

Because of the very nature of the stimulation process, most wells to be stimulated have relatively low natural pressure before the stimulation process commences. There are, however, exceptions which may require high-pressure wells to be stimulated for various reasons. In any event, once stimulated, the well may be under very high-pressure. The high-pressure may result from the use of energized stimulation fluids, well known in the art, or natural pressure developed as a result of opening up a high-pressure area of a production zone.

Consequently, situations exist in which the insertion of mandrels used to safely conduct high-pressure fluid through BOPs and other wellhead components or the removal of such mandrels from the wellhead requires mechanical control that cannot be provided by a service rig or a boom truck. For example, a well stimulated with energized fluid may overbear the weight of the mandrel with attached tools and tubing strings. In such situations, the well must be killed before a mandrel can be safely removed. As is well understood in the art, kill fluids are expensive and killing the well may reverse all or part of the beneficial effects of the stimulation process.

Methods and equipment have been devised for inserting these mandrels for protecting wellhead equipment under high-pressures. Examples of these are taught in U.S. Pat. Nos. 4,241,786, 4,867,243 and 6,470,965.

U.S. Pat. No. 4,241,786 issued to Bullen on Dec. 30, 1980, and is entitled WELL TREE SAVER. The apparatus includes a base flange connected to a pair of hydraulic cylinder pistons. Cylinder tops of the hydraulic cylinders are rigidly secured to the mandrel that is supported over top the well, so that motion of the cylinders relative to the pistons induces corresponding motion of the mandrel within the well. As will be evident to those skilled in the art, there is little space available for connecting a single high-pressure stimulation fluid supply line (i.e. a "frac" line) to a high-pressure valve that controls fluid passage through the mandrel, as the cylinders obstruct a substantial portion of a top end of the mandrel, where the high-pressure valve is located. This limited access becomes increasingly problematic when a rig is used parallel with, and proximate the well equipment, as the rig frequently obstructs a substantial part of the mandrel.

U.S. Pat. No. 4,867,243, entitled WELLHEAD ISOLATION TOOL AND SETTING AND METHOD OF USING SAME, which issued to Garner et al. on Sep. 19, 1989, teaches a method of using an apparatus having a single hydraulic cylinder for raising the mandrel from a well under pressure. While meritorious, this apparatus does not permit fluid access to the mandrel. Rather, the mandrel is stroked in, and the apparatus is removed, and then well stimulation equipment is mounted to the mandrel.

U.S. Pat. No. 6,470,965, entitled DEVICE FOR INTRODUCING A HIGH-PRESSURE FLUID INTO WELL HEAD COMPONENTS, issued on Oct. 29, 2002 to Winzer. The device includes two piston cylinders also close to the mandrel, with cylinders that extend above the mandrel top end, and accordingly provide limited access to fracturing lines.

Other devices are known for performing the insertion and removal of a casing mandrel within a well. For example the substitution of the hydraulic cylinders with respective screw jack assemblies is taught in U.S. Pat. No. 4,632,183, entitled INSERTION DRIVE SYSTEM FOR TREE SAVERS, which issued to McLeod on Dec. 30, 1986. The jack assemblies also extend above, and in parallel with, the casing mandrel, obstructing access by the fracturing lines and equipment.

A further problem with current mandrel insertion equipment is that it is a single-purpose device. In general, different equipment is required to lift and land a tubing string, and to perform other like operations (such as a rig or a boom truck, well known in the art) The expense of the single-purpose device makes a higher cost per use of mandrel insertion equipment, and increases the amount and cost of equipment required onsite. Further the alternating use of one lifting/setting device for one function, and then a second lifting/setting device for a next function requires installation and removal of the lifting/setting devices, which adds time and expense to wellhead servicing operations.

Consequently, there exists a need for an apparatus for controlling vertical motion of a tubular within a high-pressure well that provides unobstructed access to a top end of the tubular, and is adapted to permit rotation of the tubular, so that the apparatus can also be used for removing and landing a tubing string, etc.

SUMMARY OF THE INVENTION

It is therefore an object of the invention to provide an apparatus for controlling vertical movement of a tubular within a high-pressure well.

It is a another object of the invention to provide an apparatus for controlling vertical movement of either a high-pressure mandrel used for wellhead isolation, a landing joint, or other tubulars, within a high-pressure well, so that the apparatus is adapted to perform a plurality of operations.

It is a further object of the invention to provide an apparatus for controlling vertical movement of a tubular within a high-pressure well while providing unobstructed access to a top end of the tubular.

The invention therefore provides an apparatus for controlling vertical movement of a tubular in a wellbore. The tubular may be a high-pressure mandrel of a well stimulation tool or a wellhead isolation tool, or may be a landing joint. The apparatus includes an anchor spool with a bottom flange for mounting to the top of the high-pressure well in a fluid-tight seal. A top end of the anchor spool supports a high-pressure packing that seals an annulus between the top end and the tubular, while permitting vertical and rotational motion of the tubular. The anchor spool provides an anchor plate having connectors for detachably securing bottom ends of at least two piston cylinders symmetrically disposed about the anchor spool. The piston cylinders are a part of a detachable superstructure, and a tool support structure that has an adapter stack bottom end for secure connection to the tubular. The tubular may be connected directly or via one of a swivel joint, a tool that includes the tubular, and an adapter connected directly or indirectly to the tubular. Accordingly, activation of the piston cylinders causes vertical motion of the tubular within the high-pressure well.

The anchor spool preferably includes an elongated sidewall between the bottom flange and the top end. The elongated sidewall defines a passageway through the anchor spool having a diameter large enough to receive a tubing hanger. The apparatus can therefore be used to remove or land a tubing hanger in a tubing head spool.

The tool support structure includes a control plate that interconnects cylinder ends of the at least two piston cylinders. By providing for connection to the piston cylinders from below, the top side of the control plate is above the piston cylinders. The top side of the control plate includes a universal adapter that is in fluid communication with a fluid passage through the tool support structure. A union adapter in fluid communication with the fluid passage is mounted to a bottom side of the control plate. The union adapter preferably has a bottom end that terminates in a wing union that provides the adapter and permits rapid connection to the tubular.

In accordance with yet another aspect of the invention, a second apparatus for controlling vertical movement of a tubular within a high-pressure well is provided. The second apparatus includes an anchor spool that has a bottom flange for secure, fluid-tight connection atop the high-pressure well, and provides a sealed passageway through which the tubular can be vertically displaced. A tool support structure of the second apparatus includes an adapter stack bottom end for secure connection to the tubular in a same manner as that of the first apparatus. At least two piston cylinders symmetrically disposed about the tubular are secured to a bottom of the tool support structure and to the anchor spool, so that a top end of the tubular can be accessed at an adapter stack top end of the tool support structure.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

The invention provides an apparatus for controlling vertical movement of a tubular that is designed to be inserted into a high-pressure well. The apparatus includes an anchor spool, a tool support structure above the anchor spool, and a plurality of symmetrically disposed piston cylinders interconnecting the two. The tubular may be a landing joint or a high-pressure mandrel of either a well stimulation tool, or a wellhead isolation tool. The apparatus therefore has multiple uses. The apparatus further provides unobstructed access to a top end of the tubular because the piston cylinders are connected to a bottom side of the tool support structure. The piston cylinders are radially distributed to provide a balanced control force to permit installation of a well stimulation tool, or a wellhead isolation tool connected to the tool support structure.

Figure 1:
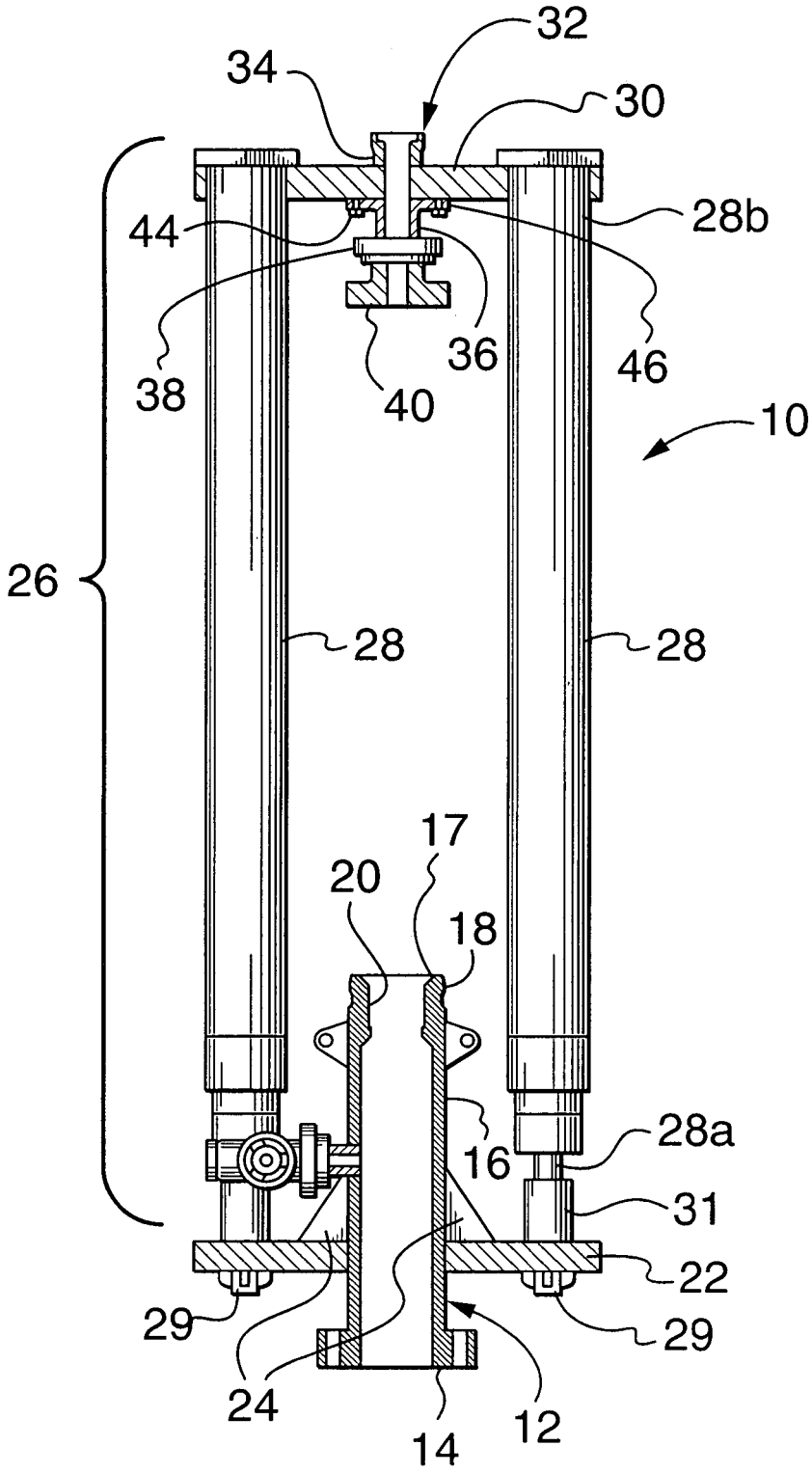
FIG. 1 is a schematic side elevational view of the apparatus in accordance with the invention for controlling vertical movement of a tubular within a high-pressure well.

FIG. 1 is a schematic side-elevational view of the apparatus 10 in accordance with an embodiment of the invention. The apparatus 10 includes an anchor spool 12 and a detachable superstructure 26. The anchor spool 12 includes a bottom flange 14, an elongated sidewall 16, and a top end 17 with a threaded adapter 18 for threaded connection of a lock-down nut, as will be described below in more detail. An axial passage through which the tubular can pass is formed through the anchor spool 12. The axial passage through anchor spool 12 is defined by an interior of the elongated sidewall 16, as can be readily seen in FIG. 1. The top end 17 also includes a packing cavity 20 for receiving and supporting a high-pressure packing, such as a Chevron packing that is well known in the art. The anchor spool 12 further includes an anchor plate 22 that extends laterally in at least two directions from the elongated sidewall 16. The anchor plate 22 is preferably welded to an outer periphery of the elongated sidewall 16 and, in one embodiment, is reinforced by gussets 24 welded between the anchor plate 22 and the elongated sidewall 16 to provide additional stabilizing support. The anchor spool 12 is constructed to safely contain pressures of at least 10,000 psi.

The detachable superstructure 26 includes at least two hydraulic cylinders 28 having ram ends 28*a* and cylinder ends 28*b*. The ram ends 28*a* are detachably connected to the anchor plate 22 by threaded connectors 29, such as wing nuts, well known in the art. The threaded connectors 29 are arrayed symmetrically about the axis of the anchor spool 12. The ram ends 28*a* of the hydraulic cylinders 28 are equipped with stabilizers 31 to enlarge a footprint of the ram ends, and therefore provide additional stability between the anchor plate 22 and the hydraulic cylinders 28. The hydraulic cylinders 28 are one example of piston cylinders.

The cylinder ends 28*b* of the hydraulic cylinders 28 are rigidly interconnected by a tool support structure that includes a control plate 30. The control plate 30 also supports an adapter stack 32. The adapter stack 32 includes a universal adapter 34 mounted to a top of a union adapter 36. The universal adapter 34 extends above the control plate 30. The union adapter 36 extends below the control plate 30, and supports a wing union 38 used to support a tool adapter 40. A fluid passage 42 through the tool support structure extends through the tool adapter 40, the union adapter 36 and the universal adapter 34. The adapter stack 32 is mounted to the control plate 30 by bolts 44 received in bores through a flange 46 of the union adapter 36.

Figure 2:
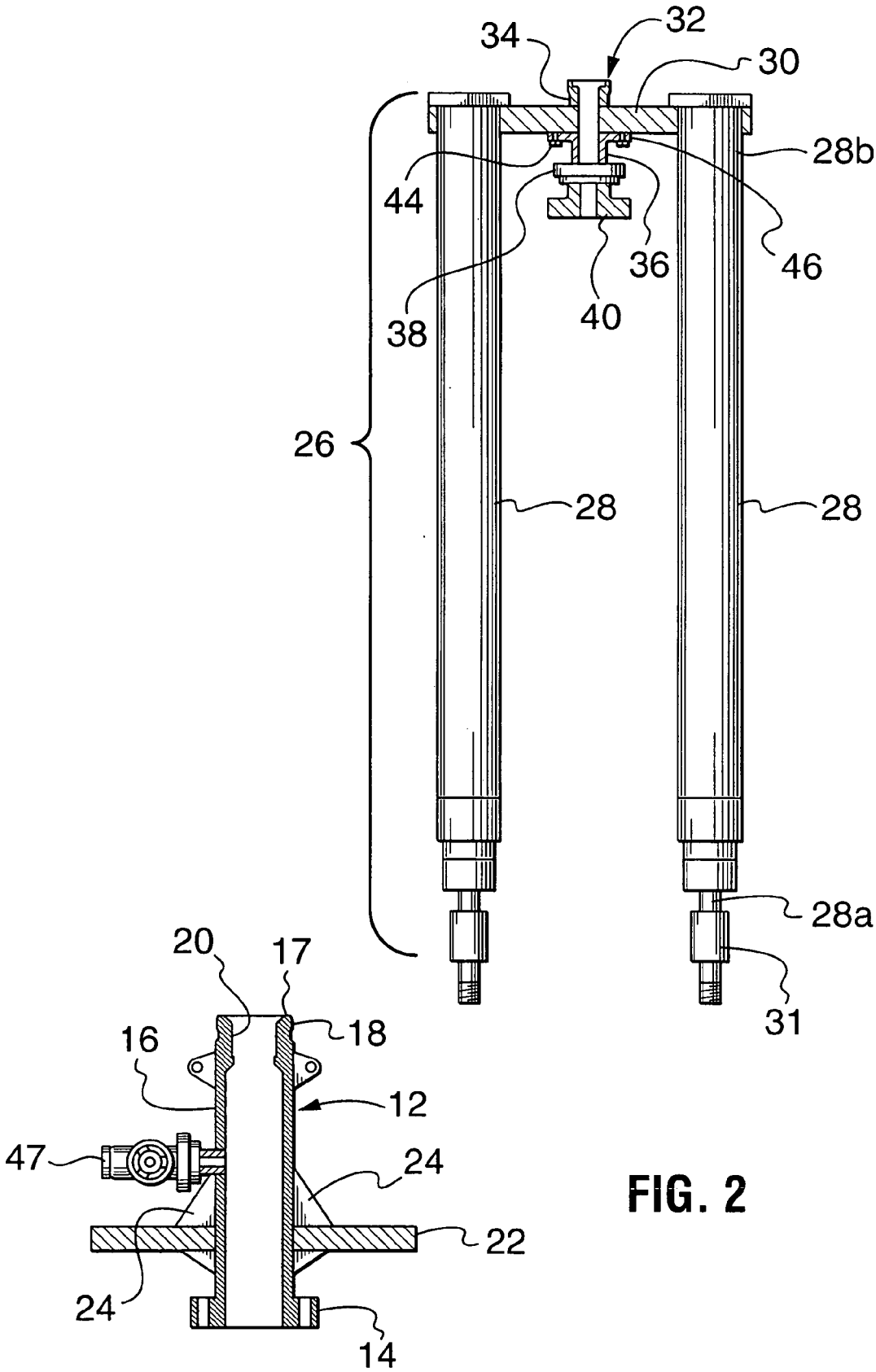
FIG. 2 is a schematic side elevational view of the apparatus shown in FIG. 1 with a detachable superstructure of the apparatus detached from an anchor spool of the apparatus.

As shown in FIG. 2, when the threaded connectors 29 are removed from the RAM ends 28*a* of the hydraulic cylinders 28, the detachable superstructure 26 can be removed from the anchor spool 12. As will be understood by those skilled in the art, it is not unusual that a well to be stimulated has low natural pressure prior to the stimulation operation. Consequently, the anchor spool 12 can be used independently of the superstructure 26 when a well tool is inserted into a low-pressure well, since the weight of the tool with attached mandrel and, optionally, attached tubing string will overbear well pressure and the tool can be readily inserted into the well. However, the anchor spool is preferably used whenever well stimulation is performed to provide a means of controllably extracting the mandrel from the well if energized fluids are used for well stimulation and/or a high-pressure formation is opened up during the well stimulation process. When either situation occurs, the superstructure 26 is mounted to the anchor spool 12 and the hydraulic cylinders 28 are operated to controllably stroke the mandrel out of the well, so that a bottom of the mandrel is above a BOP to which the anchor spool is mounted. Once rams of the BOP are closed, pressure can be bled off from the anchor spool 12 using a pressure bleed port, 47 in a manner well known in the art.

Figure 3:
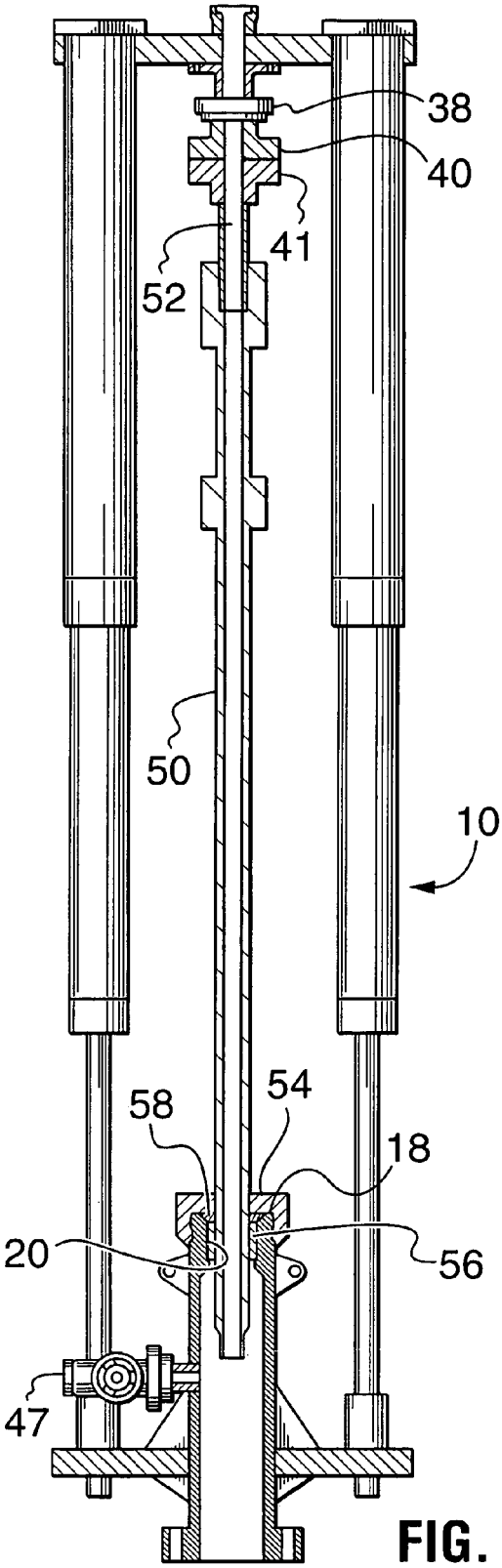
FIG. 3 is a schematic side-elevational view of the apparatus shown in FIG. 1 with a landing joint connected to a tool support structure of the apparatus, and the hydraulic cylinders in an extended condition.

FIG. 3 is a schematic side-elevational view of the apparatus 10 in which the tool adapter 40 is connected to a landing joint 50 used to remove a tubing hanger from a tubing head spool of the well or insert the tubing hanger into the tubing head spool, as described in Applicant's U.S. Pat. No. 6,595,297 which issued on Jul. 22, 2003. The landing joint 50 is preferably connected to the tool adapter 40 by a swivel joint 52. The tool adapter 40 is normally mounted to a tool adapter flange 41 connected to a top of the landing joint 50, or the optional swivel 52. Consequently, the landing joint 50 is connected to and disconnected from the detachable superstructure 26 using the wing union 38.

As shown in FIG. 3, a landing joint 50 extends through a wing nut 54 that engages the threaded adapter 18 on the top end of the anchor spool 12. The wing nut 54 secures a packing retainer nut 58, which in turn retains and compresses a Chevron packing 56 in a packing cavity 20 of the anchor spool 12 to provide a seal around the landing joint. This permits the landing joint 50 to be reciprocated through the anchor spool 12 as it is stroked into and out of the well, and further permits rotational movement of the landing joint 50. As noted above, the use of the landing joint 50 is described in detail in Applicant's U.S. Pat. No. 6,595,297.

Figure 4:
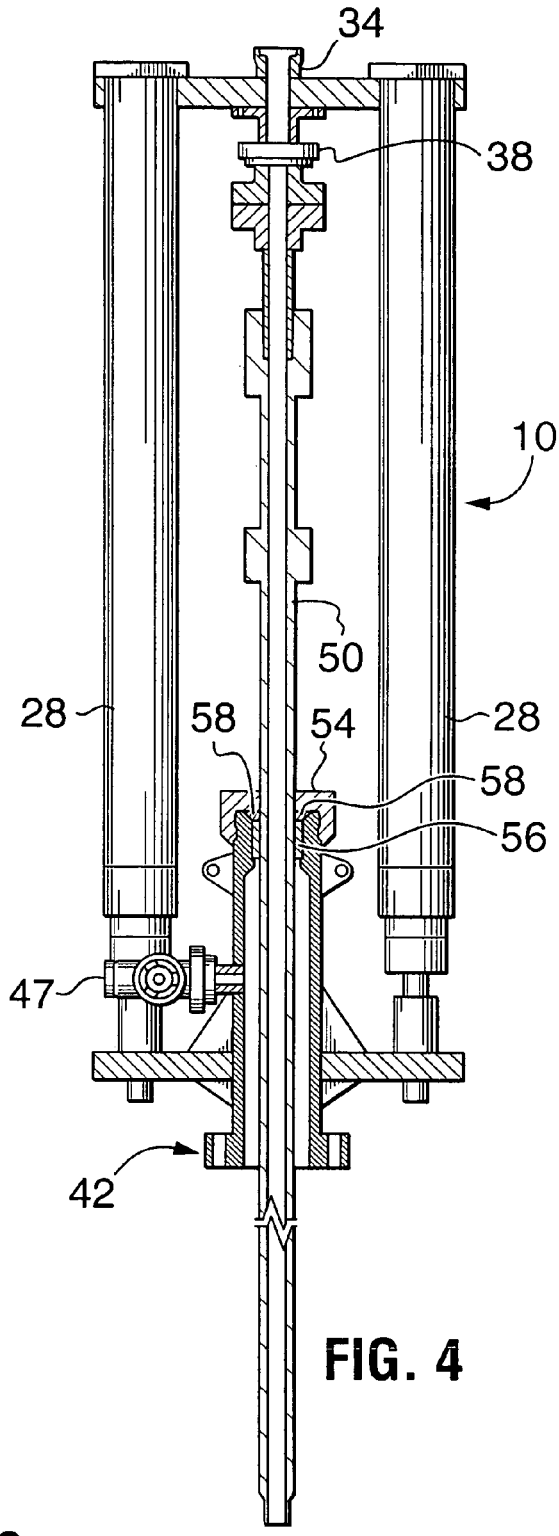
FIG. 4 is a schematic side-elevational view of the apparatus shown in FIG. 3 with the hydraulic cylinders in a retracted condition.

FIG. 4 shows the landing joint 50 stroked down into the well to a position where it is connected to a top of the tubing hanger. After the landing joint is connected to the tubing hanger, the tubing hanger and connected tubing are raised into the anchor spool 12 using the hydraulic cylinders 28 in a manner well known in the art. Tubing rams of a BOP to which the anchor spool 12 is mounted are closed, pressure is bled off through the pressure bleed port 47 in the anchor spool 12 and the apparatus 10 is hoisted by connecting a lifting sub to the universal adapter 34, and hoisting the entire apparatus along with the tubing hanger (not shown) and attached tubing (not shown) using a service rig, in a manner well known in the art.

Figure 5:
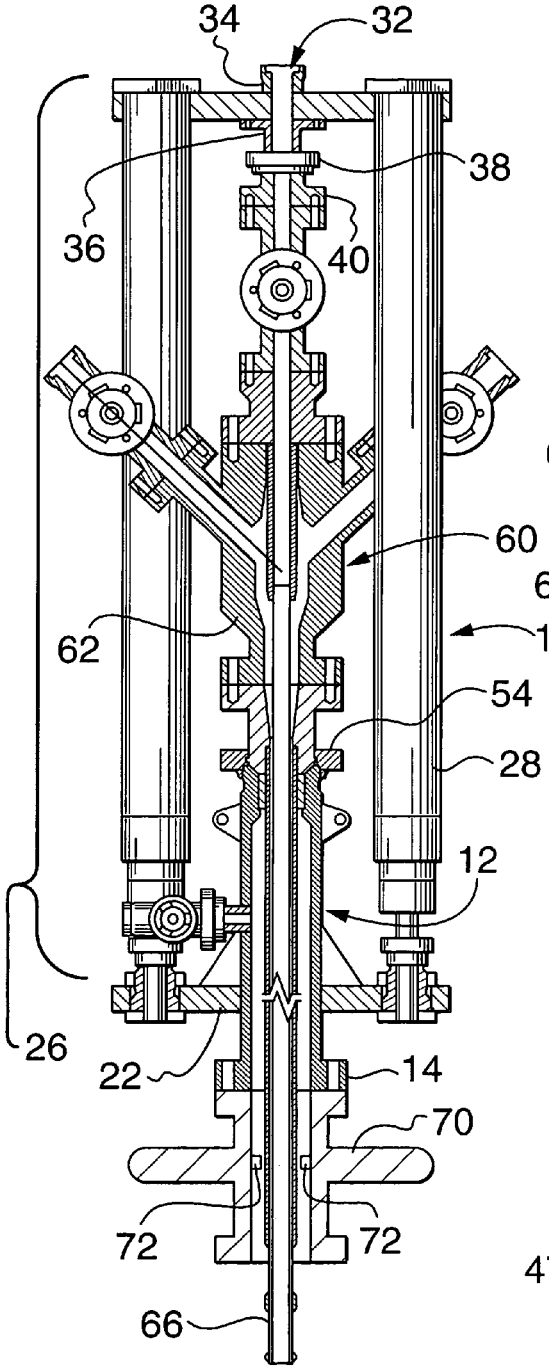
FIG. 5 is a schematic side-elevational view of the apparatus shown in FIG. 1 connected to a well stimulation tool, with the hydraulic cylinders in an extended condition.

FIG. 5 is a cross-sectional schematic view of the apparatus 10 in accordance with the invention mounted to a well stimulation tool described in U.S. Pat. No. 6,626,245 which was filed on Mar. 29, 2000. The well stimulation tool 60 includes a fracturing head 62. The well stimulation tool 60 is connected to a top of the anchor spool 12 by a lock-down nut 54. The function and use of the well stimulation tool 60, referred to as a blowout preventer protector in Applicant's pending application, is thoroughly explained in the specification of which is incorporated herein by reference. As shown in FIG. 5, the well stimulation tool 60 includes a mandrel that is fully inserted through the wellhead and a cup tool 66 that is sealingly engaged with a casing of the well (not shown).

If energized fluids are used to stimulate the well or a high-pressure formation is opened up during the stimulation process, pressure in the well may be too high to safely remove the well stimulation tool 60 without the use of the apparatus 10 in accordance with the invention. Consequently, the superstructure 26 is connected to the anchor plate 22 using the threaded connectors 29 and the wing union 38 to connect the union adapter 36 to the tool adapter 40.

Figure 6:
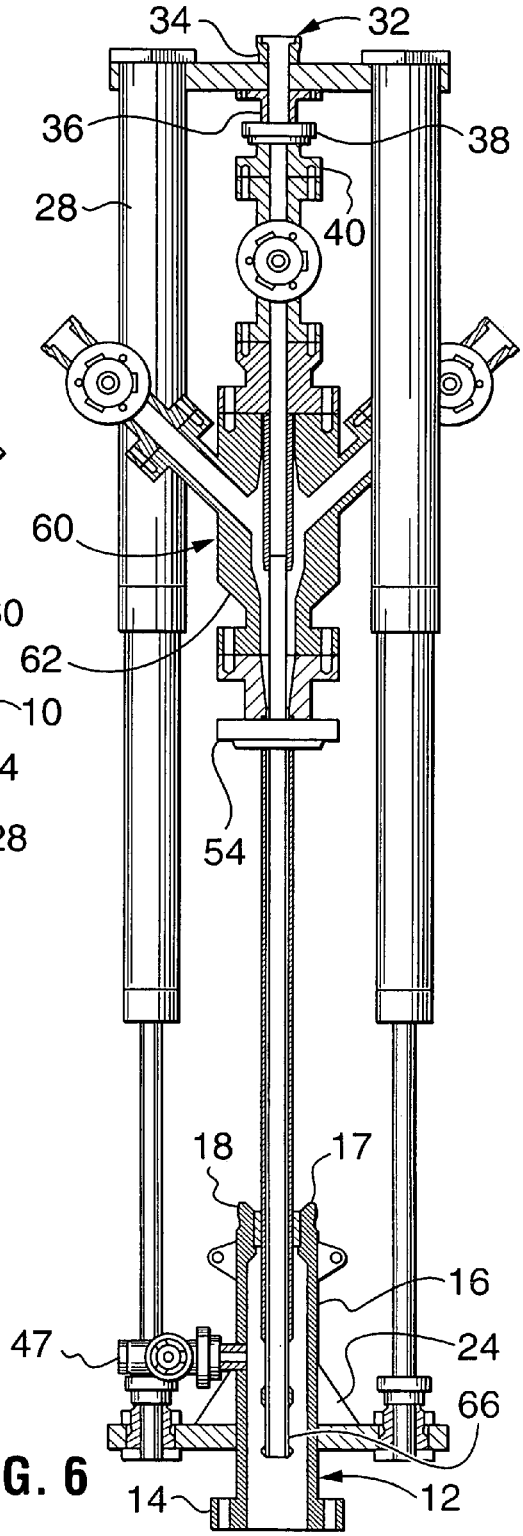
FIG. 6 is a side-elevational view of the apparatus shown in FIG. 5 with the hydraulic cylinders shown in a retracted condition.

FIG. 6 shows the well stimulation tool 60 stroked out of the well using the apparatus 10. As is apparent, the hydraulic cylinders 28 are in an extended condition and the cup tool 66 is received within the anchor spool 12. Consequently, blind rams 72 of BOP 70 (FIG. 5) can be closed. Thereafter, pressure is bled from the anchor spool 12 using the pressure bleed port 47, which permits the entire apparatus including the superstructure 26 and the anchor spool 12 to be removed from the BOP 70. Thereafter, fluid control equipment can be connected to a top of the BOP 70 and the stimulation fluids can be flowed back out of the well in a manner well known in the art.

As will be appreciated by those skilled in the art, wing union 38 permits different tools, such as the landing joint 50 (FIG. 3) and the well stimulation tool 60 (FIG. 5) to be rapidly connected and disconnected from the apparatus 10 in accordance with the invention. This makes the apparatus 10 very adaptable and permits a plurality of well stimulation procedures to be performed. The apparatus 10 is adapted to be used to insert substantially any tubular into a high-pressure well or remove the tubular from the well. In fact, the apparatus 10 is also useful for low-pressure applications as will be well understood by those skilled in the art. The rapid connection and disconnection of different tools therefore provides a very versatile control mechanism adapted for use in a wide variety of applications.

The embodiments of the invention described above are intended to be exemplary only. The scope of the invention is therefore intended to be limited only by the scope of the appended claims.

I claim:

1. An apparatus for controlling vertical movement of a tubular within a wellbore, the apparatus comprising:

an anchor spool including a bottom flange for fluid-tight connection atop a wellhead of the wellbore, a top end that supports a high-pressure packing that seals an annulus between the top end and the tubular while permitting vertical and rotational movement of the tubular, and an anchor plate having connectors for detachably securing ends of at least two hydraulic cylinders symmetrically disposed about the anchor spool; and a detachable superstructure including the at least two hydraulic cylinders and a tool support structure connected to respective opposite ends of the at least two hydraulic cylinders, the tool support structure comprising a control plate having a top side, and a bottom side, and including a fluid passage extending between the top and bottom sides, a universal adapter connected to the top side of the control plate in fluid communication with the fluid passage, and a union adapter connected to the bottom side for secure connection to the tubular, either directly or via at least one of a swivel joint, a tool including the tubular, and an adapter for connecting to the tubular, so that activation of the hydraulic cylinders causes vertical movement of the tubular within the wellbore.

2. The apparatus as claimed in claim 1 wherein the top end of the anchor spool further comprises a packing cavity for receiving the high-pressure packing, the packing cavity being a radially enlarged part of an axial passage through which the tubular can be reciprocated.

3. The apparatus as claimed in claim 2 wherein the top end of the anchor spool further comprises a pin threaded adapter for threaded engagement with a box thread of a wing nut, the wing nut being adapted to retain the high-pressure packing and seal the packing against the tubular, and includes a central bore through which the tubular may be reciprocated.

4. The apparatus as claimed in claim 2 wherein the anchor spool comprises an elongated side wall that defines the axial passage, the axial passage having a diameter large enough to permit a tubing hanger to be reciprocated therethrough.

5. The apparatus as claimed in claim 4 further comprising gussets extending between the elongated side wall and the anchor plate to reinforce the anchor plate.

6. The apparatus as claimed in claim 5 wherein the gussets and the anchor plate extend from the elongated sidewall, and a control plate which extends radially from a fluid passageway through the tool support structure, so that the hydraulic cylinders are separated by a distance that reduces obstruction of the tubular by the hydraulic cylinders, and permits a well stimulation tool to be supported between the anchor spool and the control plate.

7. The apparatus as claimed in claim 6 wherein the control plate has a top side that supports a universal adapter in fluid communication with the fluid passageway.

8. The apparatus as claimed in claim 7 wherein the adapter stack bottom end comprises a union adapter which terminates in a wing union connected to a bottom side of the control plate.

9. An apparatus for controlling vertical movement of a tubular in a wellbore, the apparatus comprising:

an anchor spool having a bottom flange for secure, fluid-tight connection atop a wellhead of the wellbore, providing a sealed axial passage through which the tubular can be vertically reciprocated;

a tool support structure comprising a control plate having a top side, and a bottom side, and including a fluid passage extending between the too and bottom sides, the control plate being securely connected to at least two hydraulic cylinders that are disposed symmetrically about the tubular, a universal adapter connected to the top side of the control plate in fluid communication with the fluid passage, and a union adapter connected to the bottom side of the control plate in fluid communication with the fluid passage, the union adapter providing secure connection to the tubular via one of a swivel joint, a tool including the tubular, and an adapter for connecting to the tubular, so that activation of at least two hydraulic cylinders causes vertical movement of the tubular within the wellbore; and the at least two hydraulic cylinders symmetrically disposed about a center of the sealed axial passage, the at least two hydraulic cylinders being radially spaced from the tubular so that unobstructed access to a top end of the tubular is provided at the union adapter connected to the bottom side of the control plate.

10. The apparatus as claimed in claim 9 wherein the union adapter terminates in a wing union for rapid connection and disconnection of the tubular.

11. The apparatus as claimed in claim 9 wherein the sealed axial passage further comprises a packing cavity for supporting packing that provides a high-pressure, fluid-tight seal when the tubular is rotated within the sealed axial passage.

12. An anchor spool for inserting a tubular in a wellbore, comprising:

a bottom flange for fluid-tight connection atop a wellhead of the wellbore;

an elongated sidewall defining an axial passage through the anchor spool that permits reciprocation of a tubing hanger therethrough, an interior surface of the axial passage supporting a high-pressure packing that seals an annulus between the tubular and the axial passage, while permitting vertical and rotational movement of the tubular; and an anchor plate secured to the elongated sidewall for detachably connecting ends of at least two hydraulic cylinders symmetrically disposed about a center of the axial passage, so opposite ends of the hydraulic cylinders connected to a bottom of a tool support structure that supports the tubular can move the tubular into or out of the wellbore, the axial passage comprising a packing cavity at a top end for receiving the high-pressure packing, and a top end of the anchor spool further comprising a pin threaded adapter for threaded engagement with a box thread of a wing nut, the wing nut being adapted to retain the high-pressure packing, and to force the high-pressure packing into sealing contact with the tubular, the wing nut providing a passage through which the tubular may be reciprocated.

13. An anchor spool as claimed in claim 12 further comprising gussets for reinforcing a welded connection between the anchor plate and the elongated sidewall.

14. An anchor spool as claimed in claim 13 wherein the anchor plate extends radially from the elongated sidewall a distance that reduces obstruction of access to the tubular by the piston cylinders, and permits a well stimulation tool mandrel to be supported over the anchor spool between the at least two piston cylinders.

15. A detachable superstructure for mounting to a high-pressure wellhead, the detachable superstructure comprising:

a control plate having a top side, and a bottom side, and including a fluid passage extending between the top and bottom sides, the control plate being securely connected to tops of cylinder ends of at least two hydraulic cylinders that are disposed symmetrically about the tubular;

a universal adapter connected to the top side of the control plate in fluid communication with the fluid passage; and a union adapter connected to the bottom side of the control plate in fluid communication with the fluid passage, the union adapter providing secure connection to the tubular via one of a swivel joint, a tool including the tubular, and an adapter for connecting to the tubular.

16. A detachable superstructure as claimed in claim 15 wherein the control plate extends radially from the fluid passage so that the hydraulic cylinders are supported away from the tubular at a distance that reduces obstruction of access to the tubular, and permits a well stimulation tool to be supported between the control plate and an anchor spool that secures the hydraulic cylinders to the high-pressure wellhead.

17. A detachable superstructure as claimed in claim 15 wherein the union adapter comprises a bottom end that terminates in a wing union to permit rapid connection and disconnection of the tubular to the bottom side of the control plate.

* * * * *

UNITED STATES PATENT AND TRADEMARK OFFICE

CERTIFICATE OF CORRECTION

PATENT NO. : 7,210,525 B2
APPLICATION NO. : 10/727806
DATED : May 1, 2007
INVENTOR(S) : L. Murray Dallas It is certified that error appears in the above-identified patent and that said Letters Patent is hereby corrected as shown below:

In the specification:
Column 2, line 47, after “art)” please insert --.--

In the claims:
Column 7, line 60, after “the” please delete “too” and replace with --top--

Signed and Sealed this

Twenty Second Day of April, 2008

JON W. DUDAS
*Director of the United States Patent and Trademark Office*